US006701639B2

(12) United States Patent
Treptow et al.

(10) Patent No.: US 6,701,639 B2
(45) Date of Patent: Mar. 9, 2004

(54) FOOT WARMER INSOLE

(76) Inventors: Christl D. Treptow, 22442 Manacor, Mission Viejo, CA (US) 92692; David Thomas Treptow, 22442 Manacor, Mission Viejo, CA (US) 92692; Phillip Oren, HC30 Box 911, Prescott, AZ (US) 86301

( * ) Notice: Subject to any disclaimer, the term of this patent is extended or adjusted under 35 U.S.C. 154(b) by 165 days.

(21) Appl. No.: 09/738,139

(22) Filed: Dec. 14, 2000

(65) Prior Publication Data

US 2002/0017035 A1 Feb. 14, 2002

Related U.S. Application Data

(63) Continuation of application No. 09/490,440, filed on Jan. 24, 2000, now abandoned, which is a continuation of application No. 09/003,450, filed on Jan. 6, 1998, now abandoned.

(51) Int. Cl.[7] ..... A43B 7/02
(52) U.S. Cl. ..... 36/2.6; 36/3 B
(58) Field of Search ..... 36/2.6, 3 B, 43, 36/44

(56) References Cited

U.S. PATENT DOCUMENTS

| | | | |
|---|---|---|---|
| 2,010,151 | A | 8/1935 | Helwig |
| 2,442,026 | A | 5/1948 | Thompson, Jr. |
| 2,680,918 | A | 6/1954 | Behner |
| 3,225,463 | A | 12/1965 | Burnham |
| 3,585,736 | A | 6/1971 | Polichena |
| 4,435,910 | A | 3/1984 | Marc |
| 5,195,254 | A | 3/1993 | Tyng |
| 5,230,170 | A | 7/1993 | Dahle |

FOREIGN PATENT DOCUMENTS

| | | |
|---|---|---|
| AT | 183678 | 6/1952 |
| DE | 351517 | 4/1922 |
| GB | 1328050 | 7/1972 |
| GB | 26531 | 2/2002 |
| WO | 86/05663 | 10/1986 |

*Primary Examiner*—Ted Kavanaugh
(74) *Attorney, Agent, or Firm*—Knobbe, Martens, Olson & Bear LLP

(57) ABSTRACT

A removable insole for footwear is disclosed which is used for heating the wearer's feet. The insole includes a recessed area for containing a heat source. The improved insole comprises an upper layer, a padding layer, a lower layer, and a cover plate. The cover plate covers the recessed area, thereby forming a cavity for containing a heat source, and extends to the tip of the toe portion. The lower layer has a plurality of recessed channels formed therein which communicate with the recessed area to facilitate the flow of air to and from the heat source. The cover layer is attached to the lower layer in only a few discrete places to facilitate the flow of air to and from the heat source. The insole and/or cover plate have at least one cutout on the periphery of one of the sides in the area of the recessed area which allows for easy insertion and removal of the heat source.

21 Claims, 4 Drawing Sheets

FOOT WARMER INSOLE

PRIOR APPLICATIONS

This application is a continuation of application Ser. No. 09/490,440, filed Jan. 24, 2000, which is a continuation of application Ser. No. 09/003,450, filed Jan. 6, 1998.

FIELD OF THE INVENTION

The present invention relates to an improved insole for footwear. More particularly, the present invention is an insole with a cavity for housing a heat source. The insole is adapted to maximize circulation of air to the heat source and maximize circulation of the heat produced thereby to the wearer's entire foot.

BACKGROUND OF THE INVENTION

It is desirable to provide an effective, inexpensive, safe, convenient and comfortable way to keep a person's feet warm in cold environments. A variety of devices and methods are known for this purpose. For example, footwear can be provided with insulation or made waterproof. Such methods have significant drawbacks. For example, waterproofing methods provide no manner of either retaining heat or providing additional heat to the wearer's feet. Rather, they only prevent the introduction of water or other liquid which could make the wearer's feet cold. Insulation is largely ineffective as well because it merely retains body heat without providing any additional heat.

One known method of providing a heat source in footwear involves placing an electric heating element in the shoe or boot liner and using a battery to supply energy to the heating element. Another attempt to solve the problem of cold feet has involved the use of electrical heating elements in socks. Foot warming devices that use electric heating elements have a number of disadvantages. First and foremost, they are dangerous. Specifically, they create the risk of electric shock, sparks that could cause flammable socks and/or footwear materials to catch fire which in turn could burn the wearer's feet, and electrical shortages. Such electrical devices are also expensive and inconvenient to use. The batteries for such devices are expensive and require long recharging times to be effective. Batteries can also leak and cause damage to the footwear and/or burn the skin of the user. Battery packs are bulky, add unnecessary weight for the user to carry and may interfere with the user's movements. A battery has the additional disadvantage that as the ambient temperature decreases, the battery's power output decreases. Therefore, as the need for heat increases, the battery powered systems decrease in effectiveness.

It has also been known to adapt the insoles of boots, shoes and the like to accommodate a heat dispensing material in a pocket formed in the insole. These devices also have significant disadvantages. Specifically, they all contemplate permanently modifying the footwear itself to accommodate the heat dispensing material. This could permanently add weight and bulk to the footwear which is unnecessary, especially when the footwear is worn in warm environments. In addition, these devices do not allow for adequate circulation of the generated heat to the wearer's feet.

U.S. Pat. No. 5,230,170, issued Jul. 27, 1993 to Dahle discloses a removable insole for footwear that has a reduced thickness portion in the padding layer creating a cavity for holding a heat source that produces heat from an exothermic chemical reaction. The insole disclosed in Dahle has an upper layer that has a plurality of holes for facilitating heat transfer from the heat source to the wearer.

Although an improvement over the prior art, the insole disclosed by Dahle also has significant drawbacks. First and foremost, the heat source is enclosed in the cavity in such a way that the amount of air that can reach the heat source is limited. Thus, because the heat source needs oxygen to drive the chemical reaction necessary to generate heat, the amount of heat produced is greatly inhibited. The heat source is also enclosed in the cavity in such a way that the heat generated by the heat source cannot adequately circulate so that the wearer's feet are not effectively heated. Further, Dahle discloses that the heat source is enclosed at its lower side by a cover plate of rigid material. The shape, size and manner in which this cover plate is connected to the insole create a propensity for the cover plate to tear away from the insole during wear, requiring the wearer to either repair or replace the insole. Further, because of the structure of the cavity, it is difficult to insert and remove the heat source from the cavity in the insole disclosed by Dahle.

It is desirable to provide an insole which overcomes the above-stated disadvantages.

SUMMARY OF THE INVENTION

In accordance with the present invention, there is disclosed an improved removable insole that provides an effective, inexpensive, safe, convenient and comfortable way to keep a person's feet warm in cold environments.

Preferably, the improved insole is formed in the general shape of the outline of the human foot, thereby having a toe portion, an arch portion and a heel portion, so that the insole can be inserted into a boot or shoe. In a preferred embodiment, the arch and heel portions contour the shape and position of the wearer's arch and heel to thereby provide support for the wearer's arch and heel.

In a preferred embodiment, the improved insole has a recessed area in the toe portion for containing a heat source. Preferably, the improved insole has an upper layer and a padding layer having an upper side connected to a lower side of the upper layer. The improved insole also preferably has a lower layer, having an upper side connected to the lower side of the padding layer. In one embodiment, the lower layer is comprised of two parts. A first part of the lower layer is formed of a pliable material, to allow for easy flexing of the toe portion during wear, and extends from the tip of the toe portion to at least past the end of the recessed area furthest from the toe portion and preferably almost to the arch of the foot. A second part of the lower layer is formed of a rigid material for durability and support, and extends from the end of the first part of the pliable lower layer to the heel portion.

Alternatively, the improved insole has a lower layer covering only a portion of the insole, formed of a rigid material for durability and support. Said lower layer extends from the heel portion to just before the edge of the recessed area furthest from the toe portion.

In the preferred embodiment, the recessed area is formed by an area of reduced thickness in the padding, upper and/or lower layer(s).

In the improved insole, a cover plate may be attached to the lower side of the insole. The cover plate extends from the tip of the toe portion to at least past the end of the recessed area furthest from the toe portion. The cover plate conforms to the shape of the insole in that section. In the improved insole, an enclosed area is thereby formed for containing a heat source. The heat source may be a commercially available device that produces heat from an exothermic chemical reaction.

The cover plate is preferably formed of a rigid material to stabilize the heat source and maintain it in a predetermined configuration to assure comfort to the wearer's foot. The cover plate is preferably not continuously attached to the insole along the cover plate's periphery or across its width, but rather is attached to the insole in a number of discrete locations forward of the recessed area and a number of discrete locations rearward of the recessed area. Such a method of attachment allows air to freely enter and exit the recessed area for improved reaction with the chemicals in the.heating element and distribution of the generated heat to the wearer's entire foot.

The insole preferably has a plurality of holes therein in the area above the recessed area for further facilitating heat transfer from the heat source to the foot of the wearer.

The lower side of the insole preferably has two sets of recessed channels formed therein that run parallel to the length of the foot. One set of recessed channels runs from the tip of the toe portion to the edge of the recessed area closest to the toe portion. The second set of recessed channels run from the edge of the recessed area furthest from the toe portion toward the heel portion, which recessed channels meet in another recessed portion of the lower layer near the heel. Such recessed channels further improve the circulation of air to the heat source to react with the chemicals in the heat source, and improve the circulation of heat from the heat source to the entire foot. The recessed portion in the lower layer near the heel also provides a cushioning effect to the wearer by absorbing shock as the wearer walks. Further, the recessed portion in the lower layer near the heel may change in volume pushing air toward the heat source and drawing heated air from the heat source toward the heel, thereby facilitating heating of the wearer's entire foot.

The improved insole also preferably has at least one cutout on at least one of the sides of the recessed area, so that upon insertion of the heat source in the recessed area, the edge of the heat source will protrude beyond the edge of the insole at the cutout, thereby allowing for easy insertion and removal of the heat source.

Further objects, features and advantages of the present invention over the prior art will become apparent from the detailed description of the drawings which follows, when considered with the attached figures.

DETAILED DESCRIPTION OF THE PREFERRED EMBODIMENT

FIGS. 1–4 best illustrate a foot warmer insole 20 in accordance with the present invention. In general, the foot warmer insole 20 is adapted to contain a heat source 21. Advantageously, the foot warmer insole 20 is constructed to allow maximum circulation of air to the heat source 21 and maximum circulation of generated heat to the wearer's entire foot.

The present invention will now be described in more detail with reference to FIGS. 1–4. It should be noted that none of the drawings are to any particular scale. The relative sizes of the features illustrated are for convenience and clarity of presentation only.

Figure 1:
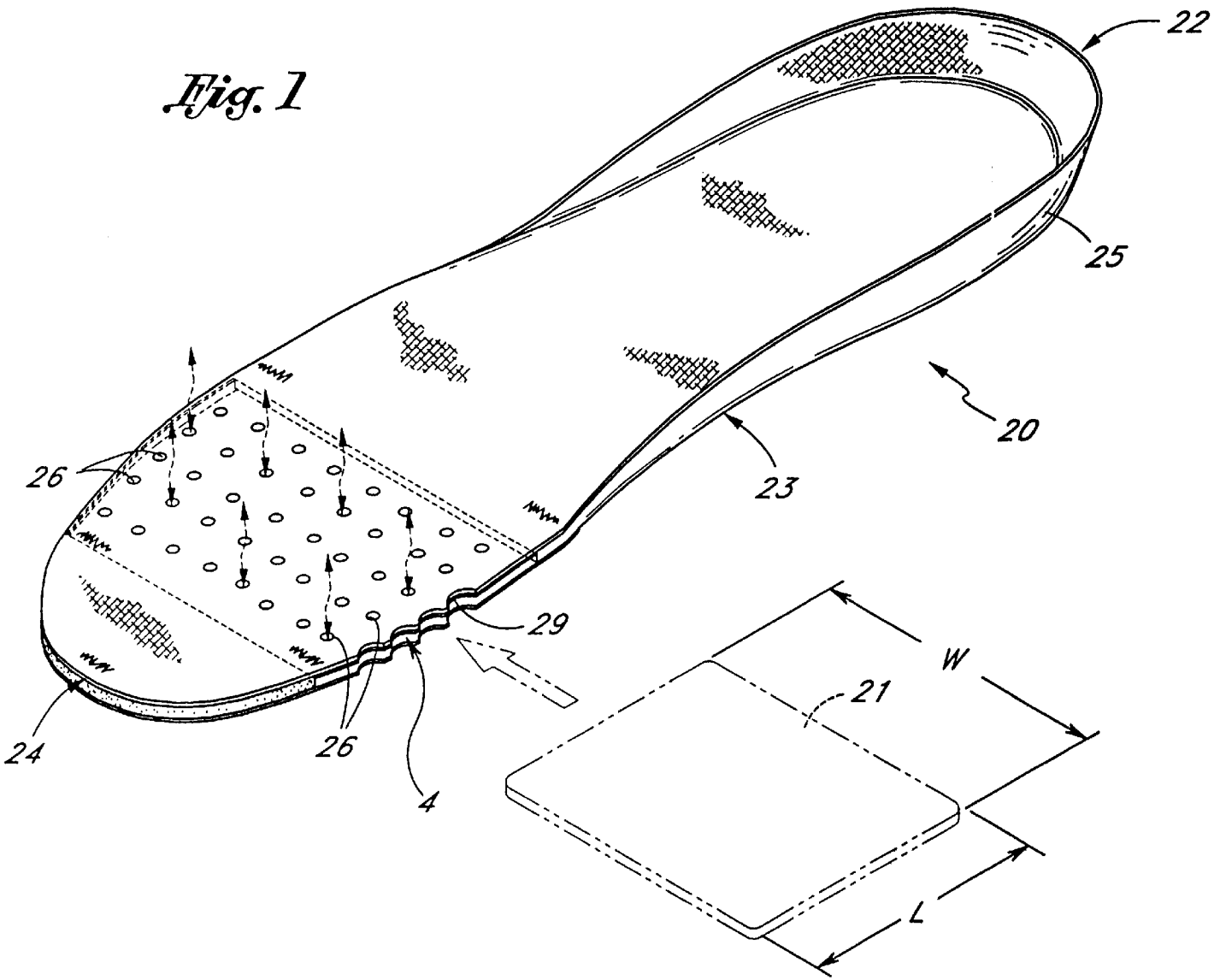
FIG. 1 is a perspective view of the foot warmer insole according to the present invention.

Referring to FIG. 1, the foot warmer insole 20 has a heel portion 22, an arch portion 23, and a toe portion 24. The insole 20 of the present invention preferably is formed in the general shape of the outline of the human foot so that it can be inserted in a boot or shoe or the like (not shown) either in place of the existing insole or on top thereof.

Figure 3:
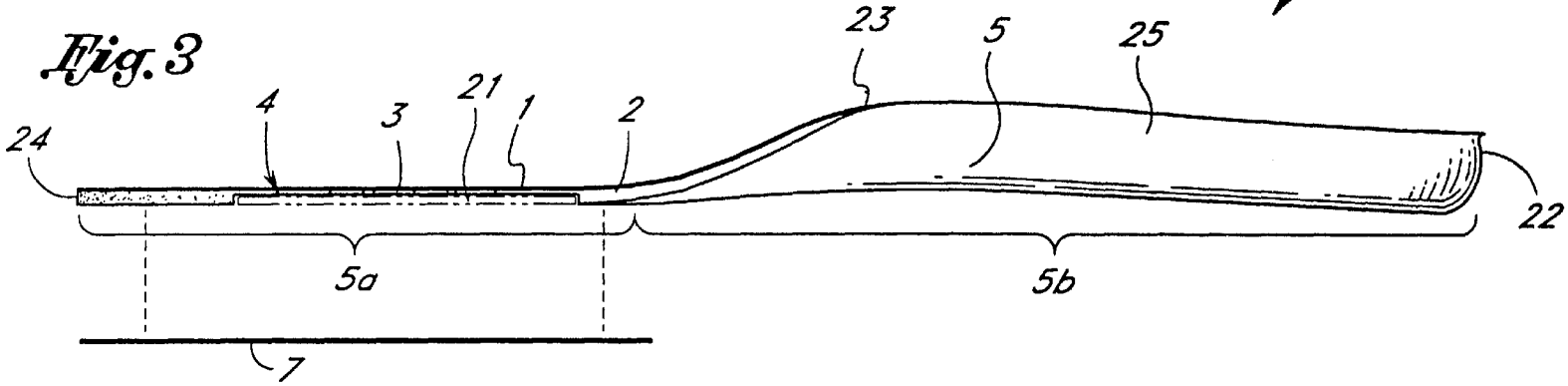
FIG. 3 is a side elevational view of a first embodiment of the foot warmer insole of FIG. 1.

Referring to FIGS. 1 and 3, the foot warmer insole 20 preferably includes a recessed area 4 for containing a heat source 21. This recessed area 4 is preferably forward of the ball of the wearer's foot. As illustrated in FIG. 1, the recessed area 4 preferably extends the entire width W of the insole 20 and is slightly longer than the length L of the heat source 21 so as to be able to accommodate the heat source 21 therein.

Referring to FIG. 3, the foot warmer insole 20 preferably includes an upper layer 1. Upper layer 1 can be formed from any of the materials known in the art for making an upper surface of an insole for a boot or shoe, such as vinyl or a fabric material.

The foot warmer insole 20 preferably has a padding layer 2 that has an upper side connected to a lower side of the upper layer 1. The padding layer 2 can be formed of any suitable material for cushioning, such as polyurethane foam. The cushioning material must be sufficiently dense that the weight of the user does not compress the insole 20 above the heat source 21. Otherwise, there might be a bulge that would cause discomfort in the user's toe region.

Referring to FIGS. 3 and 5–7, the foot warmer insole 20 preferably also has a lower layer 5 that has an upper side connected to the lower side of the padding layer 2. In one embodiment illustrated in FIGS. 3, 5 and 6, the lower layer 5 is comprised of a forward portion 5*a* and a rearward portion 5*b*. The forward portion 5*a* of the lower layer 5 extends from the tip of the toe portion 24 to at least past the end of the recessed area 4 furthest from the toe portion 24 and preferably to approximately the arch portion 23 of the insole 20. The forward portion 5*a* of the lower layer 5 is preferably formed of any number of pliable materials known in the art to allow for easy flexing of the toe portion 24 during wear. Such materials known in the art include rubber, vinyl and the like.

The rearward portion 5*b* of the lower layer 5 extends from the end of the forward portion 5*a* to the heel portion 22. The rearward portion 5*b* is preferably made of any number of rigid materials known in the art for providing durability and support to the heel and arch of the wearer's foot. Such materials known in the art include plastic, cork and the like.

Figure 7:
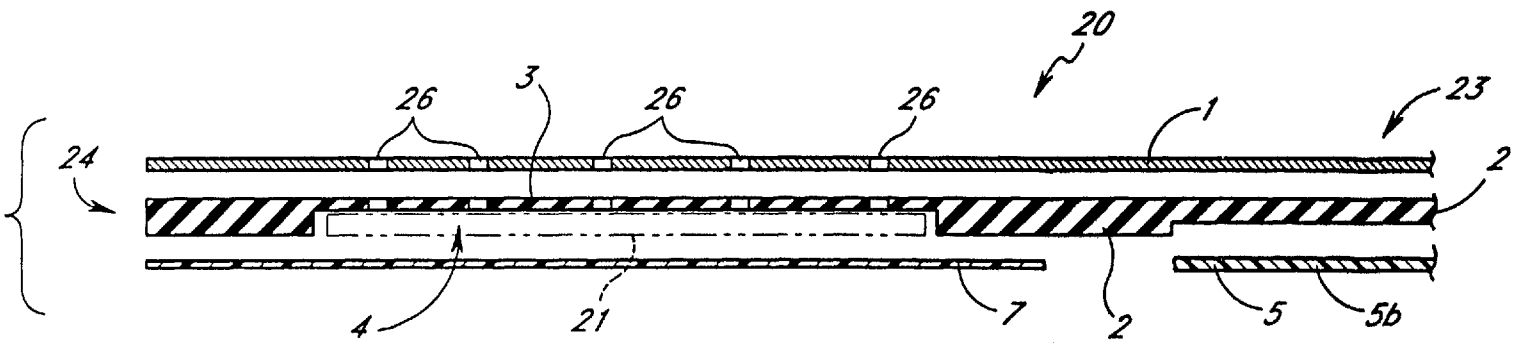
FIG. 7 is an enlarged partial cross-section along line 5—5 of FIG. 4 of a second embodiment of the foot warmer insole of FIG. 4.

In another embodiment, shown in FIG. 7, the lower layer 5 is comprised solely of the rearward portion 5*b*, as described above and as easily understood by those skilled in the art.

Figure 6:
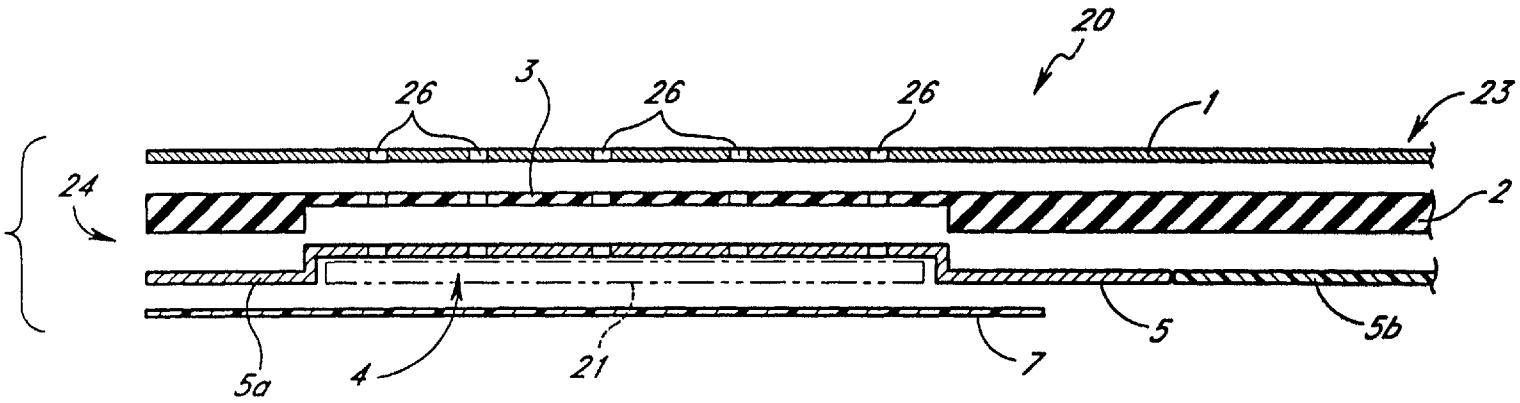
FIG. 6 is an enlarged cross-section view of the toe portion of the foot warmer insole of FIG. 5.

As shown in FIG. 6, in the preferred embodiment, the recessed area 4 is formed by an area of reduced thickness 3 in the padding layer 2, the upper layer 1 (not shown) and/or the lower layer 5*a* (not shown).

Figure 2:
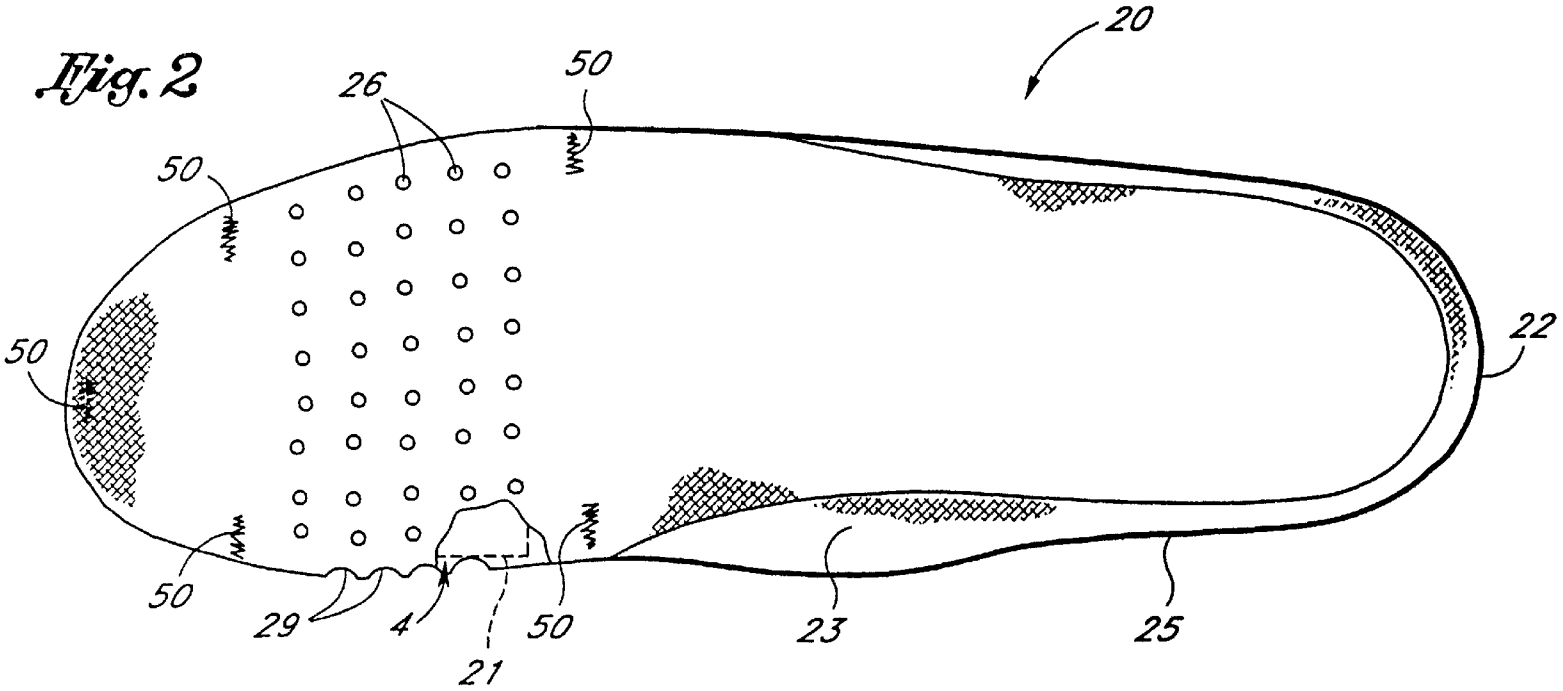
FIG. 2 is a top plan view of the foot warmer insole of FIG. 1.

As shown in FIGS. 1–3, in the preferred embodiment, in the arch and heel portions 23 and 22, respectively, the insole extends in a generally vertical direction forming walls 25 around the periphery of the insole which generally contour the shape and position of the wearer's arch and heel. Walls 25 provide support for the wearer's arch and heel during use, thereby increasing the comfort of the insole 20 and allowing for use of such insole 20 for extended periods of time. The walls 25 also stabilize the foot in the insole 20 to prevent the foot from shifting in the footwear during use. Alternatively, the insole 20 may flat and not contain vertical side walls 25.

The upper layer 1, the padding layer 2 and the lower layer 5 can be connected to each other by any method known in the art for snugly and securely connecting such layers. As is well known, such methods may include any type of adhesive, such as gluing the layers together. Another well known method is forming holes (not shown) in the lower layer 5 through which the materials of upper layer 1 and/or padding layer 2 are extruded to form a mechanism for locking the layers together.

As shown in FIGS. 3–7, a cover plate 7 is preferably attached to the forward portion of the bottom side of the insole 20. The cover plate 7 preferably extends from the tip of the toe portion 24 to at least past the end of the recessed area 4 furthest from the toe portion 24, thereby covering the recessed area 4. The cover plate 7 generally conforms to the shape of the insole 20 in that section.

The cover plate 7 is preferably formed of a thin, rigid material to stabilize the heat source 21 in the recessed area 4 and maintain it in a predetermined configuration and location, in order to prevent it from bunching up, which would be uncomfortable to a wearer. Such rigid materials well known in the art include plastic, polycarbonate and the like. The cover plate 7 should be thin enough that it does not appreciably increase the thickness of the insole 20 so as not to create discomfort to the wearer. A further advantage of the cover plate 7 as described herein is that it will be less likely to tear during wear than similar devices known in the art.

Figure 5:
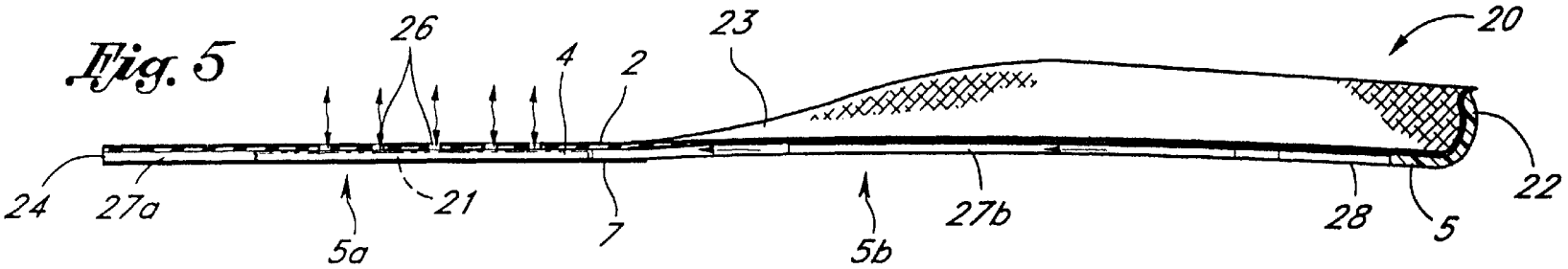
FIG. 5 is a cross-section along line 5—5 of FIG. 4 of a first embodiment of the foot warmer insole of FIG. 4.
Figure 4:
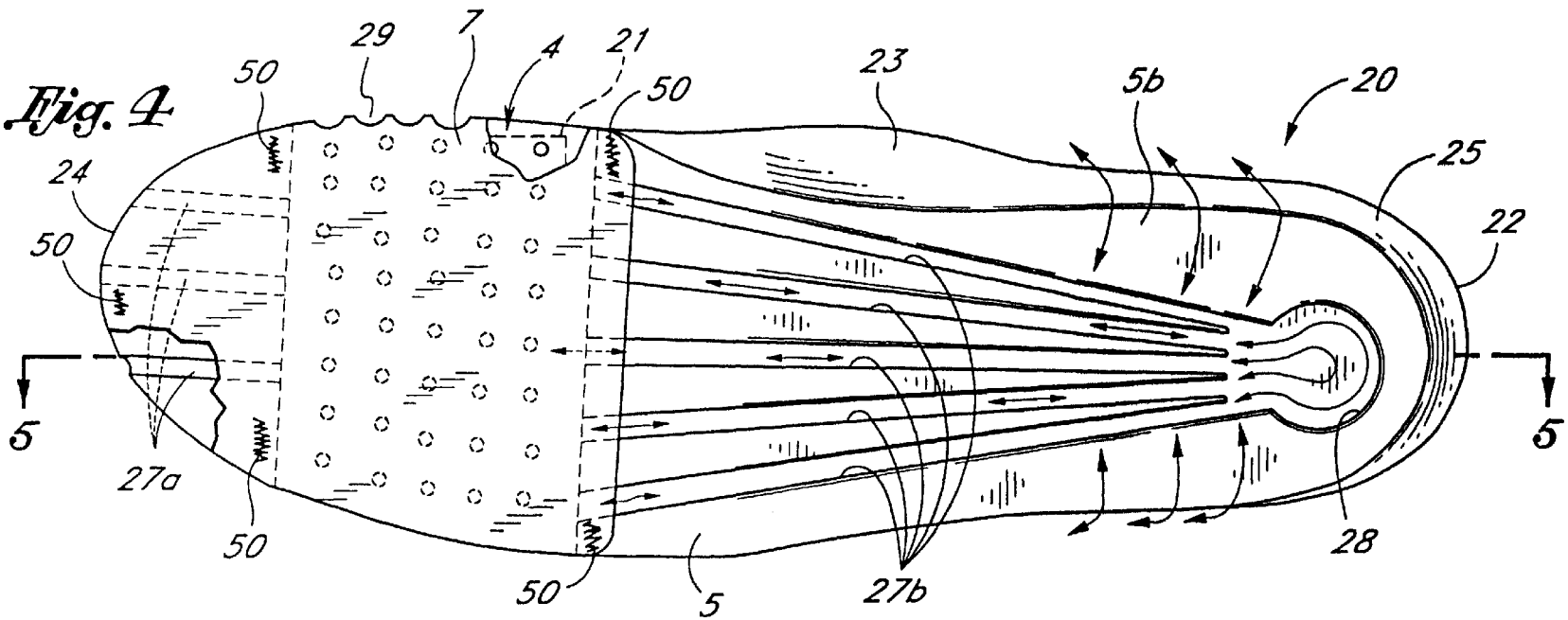
FIG. 4 is a bottom plan view of the foot warmer insole of FIG. 1.

As illustrated in FIGS. 4–6, the bottom of the insole 20 preferably has two sets of recessed channels 27*a*, 27*b* formed therein that run parallel to the length of the insole 20. One set of recessed channels 27*a* runs from the tip of the toe portion 24 to the edge of the recessed area 4 closest to the toe portion 24. The second set of recessed channels 27*b* runs from the edge of the recessed area 4 furthest from the toe portion 24 toward the heel portion 22. The second set of recessed channels 27*b* converge in another recessed area 28 of the lower layer 5*b* near the heel 22. The recessed channels 27*a*, 27*b* formed in the bottom of the insole 20 are necessarily in fluid communication with the recessed area 4. In addition to the described recessed channels 27*a*, 27*b*, the bottom of the insole 20 can have additional recessed channels running in different directions so as to provide additional channels for the flow of air. Alternatively, only one set of recessed channels 27*a*, 27*b* may be provided as will be understood by those skilled in the art. Moreover, each "set" of recessed channels may contain a single channel.

As shown in FIG. 4, the cover plate 7 is preferably not continuously attached to the bottom of the insole 20 along the periphery of the cover plate 7 or across its width, but rather is attached at a plurality of discrete locations 50 so that the attachment locations 50 do not interfere with the airflow through the recessed channels 27*a*, 27*b*. Alternatively, the loops in the thread may be spread apart so that air may travel around the thread. In this arrangement, the cover plate 7 may be secured continuously across the bottom of the insole 20. Preferably, in the area from the toe portion 24 to the edge of the recessed area 4 closest to the toe portion 24, the cover plate 7 is attached in approximately three locations 50, one location at the tip of the toe portion 24, and the other two locations adjacent the recessed area 4 and at the outer sides of the periphery of the insole 20 (FIG. 4). In the area where the cover plate 7 extends past the recessed area 4 toward the arch 23, the cover plate 7 is attached to the bottom of the insole 20 in approximately two locations 50, adjacent the recessed area 4 and at the outer sides of the periphery of the insole 20. Preferably, the cover plate 7 is not attached to the insole 20 along the periphery of the insole 20 in the area of the recessed area 4, so that openings are formed at both the inside and outside of the wearer's foot in the area of the recessed area 4. Of course, the number of attachment locations 50 may be increased or decreased.

Attaching the cover plate 7 in a noncontinuous fashion as previously described allows air to freely flow into the recessed area 4 to the heat source 21, for improved reaction with the chemicals in the heat source 21, thereby maximizing the amount and duration of heat generated by the heat source 21. Such a method for attachment also allows the heated air to freely exit the recessed area 4, for distribution of the generated heat to the wearer's foot.

The cover plate 7 can be attached to the bottom of the insole 20 in any number of ways commonly known to one of skill in the art, including, stitching, gluing, snaps, Velcro, and the like.

As best illustrated in FIGS. 1, 2 and 5–7, the insole 20 preferably has a plurality of holes 26 in the area above the recessed area 4 for further facilitating transfer of air to the heat source 21 and transfer of heat from the heat source 21 to the foot of the wearer.

Referring to, FIG. 7, an alternative embodiment of the insole 20 is provided. In this embodiment, the bottom layer 5 does not extend the entire length of the insole 20. To the contrary, only the rear portion 5*b* of the insole 20 is provided. The cover plate 7 is preferably attached directly to the padding layer 2 of the insole. The recess 4 is provided by a reduction of the thickness 3 of the padding layer 2. As will be understood by those of skill in the art, a number of configurations of the layers 1, 2, 5 and cover plate 7 may be provided in order to accomplish the goals of the present invention. For example, the insole may be injection molded of a single material. Alternatively, a different number of materials of various thicknesses may be provided at different portions of the insole 20. For example, the insole 20 may comprise only a top layer 1, a padding layer 2 and a cover plate 7 without the need for a bottom layer 5 as will be understood by those skilled in the art. These various configurations are contemplated by the present invention.

As illustrated in FIGS. 1, 2 and 4, the insole 20 and/or the cover plate 7 also preferably have at least one cutout 29 on at least one side of the wearer's foot, so that upon insertion of the heat source 21 in the recessed area 4, the edge of the heat source 21 will slightly protrude beyond the edge of the insole 20 in the cutout(s) 29, thereby allowing for easy insertion and removal of the heat source 21.

As shown in FIG. 1, in use, a heat source 21 is inserted into the recessed area 4 through either side of the insole 20. The insole 20 is then inserted into the footwear in place of the existing insole or on top thereof, thereby providing a cushion for the wearer's foot. After the heat source 21 has been exhausted, the insole 20 should be removed from the footwear. If additional heat is required, a new heat source 21 should be inserted, and the insole 20 re-inserted in the footwear. The insole 20 itself can be repeatedly reused.

There are commercially available heat sources that are suitable for placement in the recessed area 4. One preferred heat source 21 sold under the brand name HEAT FACTORY®, comprises a mixture of iron powder, water, vermiculite, active charcoal and salt in a pouch. The preferred heating element is odorless and produces no harmful fumes. The pouch is preferably formed of a fabric that retains the material therein while permitting the entrance of air into the pouch. The heat source is packaged in an air-tight container such as a cellophane envelope for storage.

When the heat source 21 is removed from the envelope, air passes through the fabric. Exposure of the material inside the pouch to oxygen causes an exothermic chemical reaction to begin. The pouch should be exposed to the air to allow the reaction to bring the pouch to a temperature high enough to provide the desired amount of heat. The rate and duration of the reaction depends upon the amount of air to which the pouch is exposed. Outside the boot or shoe, when the pouch is exposed to oxygen, it heats rapidly and may reach approximately 150E F. Inside a boot or shoe where there may be only a small amount of oxygen, the generation of heat is necessarily limited. Thus, the supply of oxygen is necessary for the chemical reaction to occur and be maintained and for heat to thereby be produced.

As shown in FIG. 4, the insole 20 of the present invention allows for the free flow of air to and from the heat source 21 in the recessed area 4. More particularly, the recessed channels 27*a*, 27*b*, and the recessed area 28 allow air from underneath the entire length of the wearer's foot to travel through the recessed channels 27*a*, 27*b* underneath the cover plate 7 and into the recessed area 4, while at the same time air above the upper layer 1 can flow into the recessed area 4 through the holes 26 to interact with the chemicals in the heat source 21, as shown in FIG. 1. Free air flow, therefore, increases the rate of the chemical reaction and heat output is increased as a result.

The recessed portion in the lower layer near the heel 28 also provides a cushioning effect to the wearer by absorbing shock as the wearer walks. Further, the recessed portion in the lower layer near the heel 28 changes in volume underneath the wearer's heel pushing air toward the heat source 21 and drawing heated air from the heat source 21 toward the heel thereby facilitating heating of the wearer's entire foot. More specifically, when a person takes a step, the heel of the person's foot contacts the ground first. Thus, the pressure from the heel of the foot depresses the insole 20 in the heel portion 22 thereby causing air in the recess 28 to move forward toward the recess 4. That is, the decrease in volume of the recess 28 forces air away from the heel portion 22 of the insole 20 through the channels 27*b* and toward the heat source 21 in the recess 4. This air assists the heat source 21 to generate heat. Later in the natural step of a person, a person's weight is transferred from the heel to the toe. Once the heel of a person is lifted off of the ground, the volume of the recess 28 increases, thereby creating a vacuum. Air is then forced from the heat source 21 in the recess 4 through the channels 27*b* toward the recess 28. As this air is heated, the channels 27*b* provide for substantial heating of a wearer's entire foot. The channels 27*a* operate in a similar fashion.

Similarly, the recessed channels 27*a*, 27*b*, the recessed area 28 and the holes 26 allow heat generated from the heat source 21 to be distributed directly to the wearer's foot through holes 26 and more indirectly, by travelling through the recessed channels 27*a*, 27*b*, throughout the length of the insole 20 to heat the entire length of the insole 20, thereby heating the entire length of the wearer's foot. It is also noted that the insole of the present invention allows the free flow of air to and from the heat source 21, where it is needed, in yet another way. The insole 20 does not perfectly nest within the shoe and the generally vertical sides 25 of the insole 20 do not exactly conform to the inside of the vertical sides of the footwear. Rather, there is space between the generally vertical sides 25 of the insole 20 and the inside walls of the footwear. As a result, as illustrated in FIG. 4, the generally vertical sides 25 of the insole 20 serve as guides for air in the boot or shoe travelling down the sides of the wearer's foot, to travel between the vertical sides 25 and the inside of the boot or shoe, and thereby underneath the insole 20 to the recessed area 4 and the heat source 21. Similarly, heat generated by the heat source 21 will heat the entire insole 20, including the vertical sides 25, thereby stimulating the travel of the generated heat up the sides of the wearer's foot. In addition, the vertical sides 25 can serve as guides for the heated air to travel outside the insole 20 and vertically up between the vertical sides 25 and the insides of the boot or shoe, into the general interior of the boot or shoe to thereby completely surround the wearer's foot with the generated heat.

Thus, advantageously, the insole of the present invention permits a heating source, while positioned in one area in the insole, to heat the entire foot of the wearer, rather than containing heat in the region the heating source is located.

A further advantage of the insole of the present invention is that it is easily insertable and removable from the boot or shoe. Accordingly, it can be inserted only when needed and removed when not needed.

It will be understood that the above described structure and method of use are merely illustrative of applications of the principles of this invention and many other embodiments and modifications may be made without departing from the spirit and scope of the invention as defined in the claims which follow.

I claim:

1. An insole for footwear formed in the general shape of the outline of the human foot, said insole having a toe portion, an arch portion and a heel portion comprising:

a recessed area in said toe portion of said insole;

a substantially rigid cover plate attached to a bottom surface of said toe portion of said insole, said cover plate enclosing said recessed area, thereby forming a cavity for holding therein a heat source, said cover plate extending to a tip of said toe portion;

at least one channel in said insole in fluid communication with said recessed area; and at least one cutout on the periphery of said recessed area for facilitating insertion of said heat source therein and removal of said heat source therefrom.

2. The insole of claim 1, wherein said at least one channel is a part of a plurality of channels in said insole in fluid communication with said recessed area.

3. The insole of claim 2, wherein each channel extends from said toe portion to said heel portion.

4. The insole of claim 1, wherein said recessed area is forward of the ball of a wearer's foot.

5. The insole of claim 1, further comprising an upper layer, a padding layer connected to said upper layer, and a lower layer connected to said padding layer.

6. The insole of claim 1, wherein said at least one channel comprises a set of channels extending from said tip of said toe portion and in fluid communication with an end of said recessed area closest to said toe portion.

7. The insole of claim 6, further comprising a second set of channels extending from said heel portion and in fluid communication with said end of said recessed area furthest from said toe portion.

8. The insole of claim 7, wherein said second set of channels is in fluid communication with a second recessed area in said heel portion.

9. The insole of claim 8, wherein said second recessed area has a variable volume.

10. An insole for footwear formed in the general shape of the outline of the human foot, said insole having a toe portion, an arch portion and a heel portion, comprising:

a recessed area in said toe portion of said insole;

a substantially rigid cover plate attached to a bottom surface of said toe portion of said insole, said cover plate enclosing said recessed area, thereby forming a cavity for holding therein a heat source, said cover plate extending to a tip of said toe portion;

at least one channel in said insole in fluid communication with said recessed area;

an upper layer, a padding layer connected to said upper layer, and a lower layer connected to said padding layer; wherein said lower layer comprises:

a forward portion extending from said tip to said toe portion to past an end of said recessed area furthest from said toe portion; and a rearward portion extending from an end of said forward portion furthest from said toe portion to said heel portion;

said rearward portion of said lower layer being formed of a rigid material that is adapted to provide support to the heel and arch of a wearer's foot.

11. The insole of claim 10, wherein said recessed area is forward of the ball of a wearer's foot.

12. The insole of claim 10, wherein said forward portion of said lower layer is formed of a flexible material to allow for easy flexing of said toe portion during use.

13. The insole of claim 10, wherein said insole extends in a generally vertical direction around the periphery of said arch and heel portions, whereby said insole is adapted to provide support to a wearer's foot.

14. The insole of claim 10, wherein said cover plate is attached to said bottom surface of said insole at a number of discrete locations so as not to interfere with a flow of air between said recessed area and said at least one channel.

15. The insole of claim 10, wherein said at least one channel comprises a set of channels extending from said tip of said toe portion and in fluid communication with an end of said recessed area closest to said toe portion.

16. The insole of claim 15, further comprising a second set of channels extending from said heel portion and in fluid communication with said end of said recessed area furthest from said toe portion.

17. The insole of claim 16, wherein said second set of channels is in fluid communication with a second recessed area in said heel portion.

18. The insole of claim 10, wherein said cover plate is formed from a plastic material.

19. The insole of claim 10, wherein said cover plate is formed from a polycarbonate material.

20. A method for heating a human foot, comprising the steps of:

inserting a heat source in a first recessed area in a toe portion of an insole;

inserting said insole into footwear;

circulating air to and from said heat source through at least one channel in said insole in fluid communication with said first recessed area; and providing a second recessed area in said heel portion, said second recessed area having a variable volume that facilitates air circulation between said recessed areas during use of said insole.

21. The method of heating a human foot of claim 20, wherein said step of circulating air to and from said heat source is facilitated through two sets of channels formed in said insole, a first set comprising at least one channel extending from a tip of said toe portion and in fluid communication with a first end of said first recessed area closest to said toe portion, and a second set comprising at least one channel extending from the second recessed area in the heel portion of said insole and in fluid communication with a second end of the first recessed area furthest from said toe portion, and wherein said at least one channel is a part of one of said sets of channels.

* * * * *